United States Patent [19]

Orikasa et al.

[11] Patent Number: 4,555,295

[45] Date of Patent: Nov. 26, 1985

[54] ADHESIVE FILLER APPARATUS

[75] Inventors: Wataru Orikasa; Makoto Ohara; Tomoyuki Mori; Masayoshi Shigetomi; Katsuji Yamaga; Masaaki Matsui; Hiroshi Saito; Hiroshi Sōda, all of Tokyo, Japan

[73] Assignees: Nippon Telegraph and Telephone Public Corporation; Sho-Bond Construction Co., Ltd.; Communication Architecture and Building Research Corporation, all of Tokyo, Japan

[21] Appl. No.: 670,844

[22] Filed: Nov. 13, 1984

[30] Foreign Application Priority Data

Dec. 20, 1983 [JP] Japan ..... 58-238973

[51] Int. Cl.[4] ..... B32B 35/00

[52] U.S. Cl. ..... 156/349; 141/1; 141/114; 156/94; 156/578; 222/213; 222/215; 264/36; 404/107; 425/13; 427/140

[58] Field of Search ..... 141/1, 114, 25, 351; 156/94, 349, 578; 222/92, 105, 107, 213, 215, 632, 633; 264/36; 404/107; 425/12, 13; 427/140

[56] References Cited

U.S. PATENT DOCUMENTS

| | | | |
|---|---|---|---|
| 926,129 | 6/1909 | Murrie | 425/13 X |
| 1,926,415 | 9/1933 | Wertz | 425/13 |
| 3,255,788 | 6/1966 | Cook | 141/25 |
| 4,132,516 | 1/1979 | Story | 156/94 X |
| 4,245,970 | 1/1981 | St. Onge | 425/13 |
| 4,280,861 | 7/1981 | Schwartz | 156/94 X |
| 4,385,015 | 5/1983 | Klettke | 264/36 |

FOREIGN PATENT DOCUMENTS

| | | | |
|---|---|---|---|
| 1948492 | 11/1970 | Fed. Rep. of Germany | 141/351 |

*Primary Examiner*—Robert A. Dawson
*Attorney, Agent, or Firm*—Armstrong, Nikaido, Marmelstein & Kubovcik

[57] ABSTRACT

An adhesive filler apparatus is disclosed comprising an injector and a support portion, the injector comprising a pressure buffer tube made of elastic material and a check valve adjacent one end of the pressure buffer tube, the support portion comprising a base member and a projection. The adhesive filler apparatus disclosed is used as follows: An adhesive is fed through a hose connected to a pump, etc. in the pressure buffer tube, causing the tube to swell. The hose is disconnected from the injector, causing the check valve to close the end of the tube. The fed injector is coupled to the support portion fixed on the crack of a concrete structure, etc., whereupon the projection on the support portion presses the check valve to open the end of the fed tube, thereby allowing the adhesive in the tube to be filled in the crack by gradual and continuous contraction of the elastic tube.

2 Claims, 5 Drawing Figures

ADHESIVE FILLER APPARATUS

BACKGROUND OF THE INVENTION

The invention relates to an adhesive filler apparatus which can be used in an adhesive filling operation and especially to an adhesive filling operation to repair the cracks developed in concrete structure or other like portions needing to be repaired.

Cracks in the structures made of concrete or stones are generally repaired by filling putty or adhesive therein.

Recently a method was proposed whereby adhesive supply pipes are fixed along the cracks at appropriate space intervals with the remaining spaces sealed and, upon hardening of the sealing material, said pipes are coupled to a supply pump to fill adhesive in the cracks (Japanese Pat. No. 251791).

While cracks can be effectively repaired according to this method, some difficulties are encountered in the operation. For example, increase in the rate at which adhesive is filled in the cracks may cause increase in the pressure applied to the cracks owing to the viscosity of the adhesive and thus the hardened sealing material may be ruptured or the cracks widened. Therefore according to such method, adhesive must be filled at as slow a rate as 3 to 5 minutes per one adhesive-filled portion and thus workmanship is required.

To eliminate those drawbacks, another method was recently proposed whereby adhesive is reserved temporarily in a pressure buffer portion to deaden the pressure applied to the adhesive-filled portion such as cracks, whereupon the reserved adhesive is filled by the gradual and continuous contraction of said pressure buffer portion (Japanese Pat. Kokai No. 2367/1981). This was followed by proposal of an adhesive filler apparatus to be used in this method, which apparatus is equipped with a check valve device for preventing the adhesive fed in the pressure buffer portion from flowing backward (Japanese Pat. Kokai No. 87866/1982).

While the cracks developed in concrete buildings could be repaired very effectively by such method and apparatus, check of the quantity of the adhesive used could not be obtained very easily.

Further according to any conventional methods, a great amount of operation needed to be performed on the spot since adhesive had to be filled in the cracks of concrete structure, etc. using a pump on the spot in addition to the adhesive filler apparatus.

SUMMARY OF THE INVENTION

The apparatus according to the invention comprises a support portion and an injector, said support portion including a base member for locating the support portion on the portion to be repaired and a tubular coupler projection with a passage therethrough, said injector including a pressure buffer tube made of elastic material, a tubular coupler member adjacent an end of said pressure buffer tube whereby said injector is connected to said coupler projection of said support portion, and a valve device provided between said pressure buffer tube and said coupler member, the other end of said injector being adapted to be closed upon having fed adhesive in said pressure buffer tube, said valve device closing the passage of adhesive through said pressure buffer tube and said coupler member while said pressure buffer tube is swollen by the adhesive fed therein whereas said valve device restoring said passage of adhesive in response to the pressure applied to it from the coupler member side.

Where necessary, the injector may be provided with a sheath around it to limit its expansion.

DETAILED DESCRIPTION OF THE INVENTION

The invention will now be described below in detail referring to the attached drawings.

Figure 1:
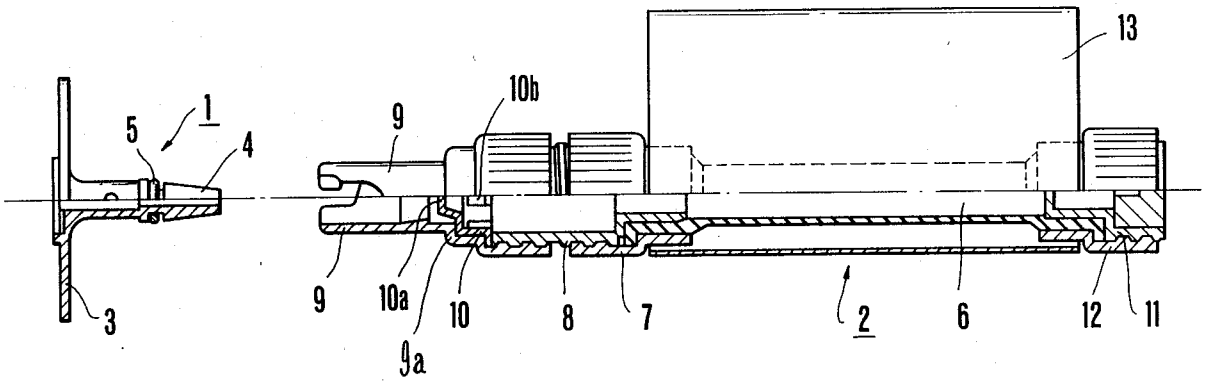
FIG. 1 shows an embodiment of the invention, half of it in cross section, with the pressure buffer tube empty.

Referring to FIG. 1, a support portion 1 comprises a base member 3 and a tubular coupler projection 4. The base member 3 is formed on one end of the coupler projection 4. The other end of the coupler projection 4 has a tapered end with such an outer diameter as to be fitted in a coupler member to be described. The coupler projection 4 is long enough to press a valve device to be described.

The support portion 1 may be made of any suitable material such as metal or synthetic resin. The base member 3 and the coupler projection 4 may be made of the same material or different materials. A rubber-made O-ring 5 provided on the coupler projection 4 serves as a packing in the connection between the coupler projection and the coupler member.

An injector 2 comprises a pressure buffer tube 6, the coupler member 9 adjacent one end of the pressure buffer tube 6, and a valve device 10 between the pressure buffer tube 6 and the coupler member 9. The other end of the pressure buffer tube 6 is made capable of being closed as will be described. The coupler member 9, the valve device 10, and the closed end portion may be formed separately from or unitarily with the pressure buffer tube 6.

The pressure buffer tube 6 is made of elastic material such as rubber so as to be capable of expanding. One of the thickened end of the tube 6 is fitted and held in between the inner surface of an outer cylindrical member 7 and the outer surface of an inner cylindrical member 8. The outer cylindrical member 7 and the inner cylindrical member 8 are firmly united with each other with the thread formed on the inner wall of the outer cylindrical member 7 engaged with the thread formed on the outer wall of the inner cylindrical member 8. The outer end of the inner cylindrical member 8 extends longer than the outer end of the outer cylindrical member 7.

The free end of the coupler member 9 has an inner diameter in which the coupler projection 4 can be fitted while the other end of the coupler member 9 has a greater inner diameter than said free end and is formed on its inner wall with thread which engages with the thread formed on the outer wall of the inner cylindrical member 8. Thus the coupler member 9 is united with the inner cylindrical member 8 by thread engagement.

The valve device 10 has a cup-like shape made of deformable synthetic resin with a closure head 10*a* serving to shut the passage through the pressure buffer tube 6 and the coupler member 9. The valve device 10 also has flow apertures 10*b* in its peripheral wall located between a stepped portion 9*a* at which the diameter of the coupler member 9 changes and the end surface of the inner cylindrical member 8.

The coupler member 9 and the valve device 10 may be of a type connected directly to the pressure buffer tube 6 without the outer cylindrical member 7 and inner cylindrical member 8 in between. Also, the valve device 10 may be of any other feasible type. For example, a ball valve may be used.

Upon having fed an adhesive such as epoxy resin, ester resin or the like in the pressure buffer tube 6, the other thickened end thereof is tightly held between the outer wall of a blind stopper 11 and the inner wall of a cap member 12. The blind stopper 11 is formed on its outer surface with thread along its outer length than its remaining length holding said thickened end of the tube 6. The cap member 12 also is formed with thread on its inner surface along its corresponding length. This enables the blind stopper 11 and the cap member 12 to be united with each other so as to firmly close the end of the pressure buffer tube 6. The blind stopper 11 and the cap member 12 may be made of any suitable material such as metal or synthetic resin. To feed the pressure buffer tube 6 with adhesive, a pump, etc. is used until the tube 6 is swollen to some extent. Where necessary, a sheath 13 may be provided around the pressure buffer tube 6 so as to limit the quantity of adhesive which can be fed in the tube 6. The sheath 13 may be a cylinder with an inner diameter determining a maximum diameter desired of the expanded tube 6. The sheath 13 further serves to prevent the tube 6 from rupturing due to overfeeding.

Figure 2:
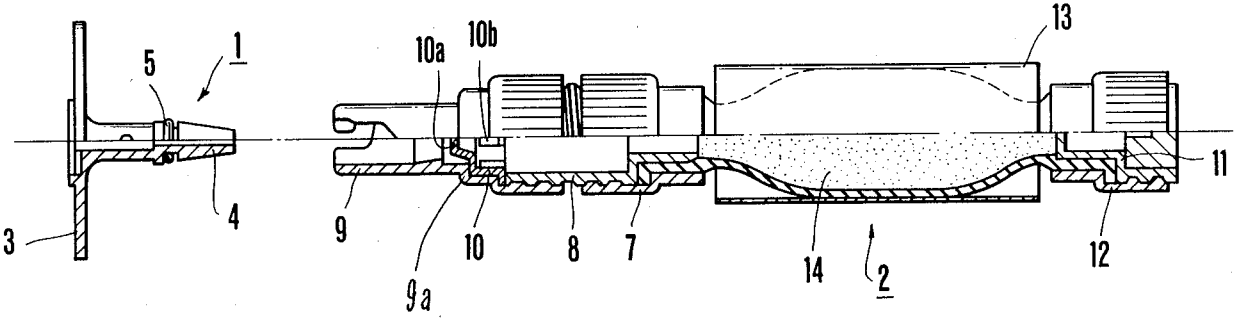
FIG. 2 is a view similar to FIG. 1 but showing the pressure buffer tube fed with adhesive.

FIG. 2 shows the apparatus with the pressure buffer tube 6 swollen up to the sheath 13 after having been fed with an adhesive 14. Provision of the sheath 13 enables a given quantity of adhesive to be fed in the pressure buffer tube 6.

The embodiment as described above is used as follows.

Figure 3:
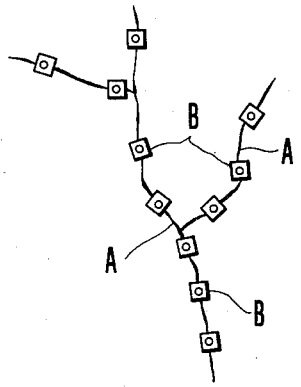
FIG. 3 is a top plan view schematically showing a plurality of apparatus according to the invention as used on a concrete structure.

FIG. 3 shows the embodiments B of the adhesive filler apparatus according to the invention located at intervals of about 20 to 40 cm on cracks A developed in the wall of a concrete building.

Figure 4:
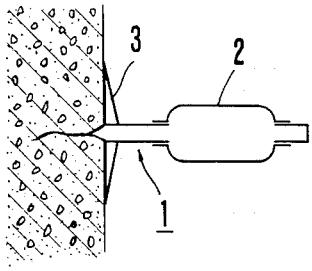
FIG. 4 is an elevation better showing one of the apparatus shown in FIG. 3.
Figure 5:
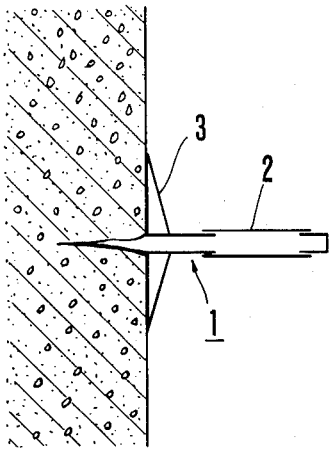
FIG. 5 is a view similar to FIG. 4 but showing the apparatus of which the pressure buffer tube has contracted.

FIG. 4 better shows the manner in which each apparatus is fixed on the crack. To fix the apparatus on the crack, the base member 3 of the support portion 1 is adhered to the crack by means of putty whereas the remaining crack portions between the apparatus are sealed by putty. Subsequently the injector 2 is coupled to the support portion 1 by fitting the coupler member 9 on the coupler projection 4 of the support portion 1, whereupon the fore-end of the coupler projection 4 presses the closure head 10*a* of the valve device 10. As a result, the valve device 10 is deformed to restore passage of adhesive through flow apertures 10*b*, thereby allowing the adhesive 14 reserved in the pressure buffer tube 6 to be filled in the cracks A as the pressure buffer tube 6 contracts gradually and continuously of itself. After the adhesive is filled in the cracks A, the pressure buffer tube 6 assumes a form as shown diagrammatically in FIG. 5.

Using the adhesive filler apparatus according to the invention, the quantity of the adhesive fed in the pressure buffer tube can be checked so that the quantity filled into the cracks in a concrete building, etc. can be known by comparing the quantity fed in the pressure buffer tube with the quantity left therein after filling the adhesive into the cracks, etc., for example, by weighing the injector before and after filling adhesive into the cracks in a concrete building, etc.

Further because the pressure buffer tube is provided at one end with the valve device which normally provides a closure and the other end is closed, the adhesive reserved in the pressure buffer tube is free from leakage. This makes an on-the-spot adhesive feeding operation using a pump unnecessary since a plurality of adhesive filler apparatus according to the invention can have been fed with adhesive in advance. Also a quantity of adhesive expected to be required can be prepared beforehand by feeding a corresponding number of adhesive filler apparatus in advance.

An excellent performance is another benefit of the apparatus according to the invention, in which a closure provided by the valve device is cleared upon connecting the coupler member of the injector to the coupler projection of the support portion with its base member previously located on the cracks of buildings, etc., and upon clearing of the closure, the adhesive is filled in the cracks of buildings, etc. by gradual and continuous contraction of the pressure buffer tube due to its elasticity.

Still further, since the end of the pressure buffer tube opposite to the other end with which the support portion is coupled is closed, no means need be purposely provided to prevent adhesive from flowing backward upon detaching the pump.

We claim:

1. An adhesive filler apparatus comprising a support portion provided at one end with a base member for locating the support portion on the portion which is to be repaired by filling an adhesive therein and at the other end with a tubular coupler projection, an injector including a pressure buffer tube, a tubular coupler member at one end of said pressure buffer tube for connecting the injector to said support portion, and a valve device between said pressure buffer tube and coupler member, the other end of said pressure buffer tube being made capable of being closed, the closure provided by said valve device being cleared upon connecting said coupler member to said coupler projection.

2. An adhesive filler apparatus according to claim 1, comprising a sheath around the pressure buffer tube.

* * * * *